US005730652A

United States Patent [19]

Van Becelaere

[11] Patent Number: 5,730,652

[45] Date of Patent: Mar. 24, 1998

[54] DAMPER WITH STATIONARY PITOT-STATIC SENSING VANES

[75] Inventor: Robert M. Van Becelaere, Lake Lotawana, Mo.

[73] Assignee: Tomkins Industries, Inc., Dayton, Ohio

[21] Appl. No.: 627,603

[22] Filed: Apr. 4, 1996

[51] Int. Cl.[6] ..... F24F 7/00

[52] U.S. Cl. ..... 454/335; 454/238; 73/861.66; 137/12; 137/557

[58] Field of Search ..... 454/335, 238, 454/264, 265

[56] References Cited

U.S. PATENT DOCUMENTS

| | | | |
|---|---|---|---|
| Re. 30,204 | 2/1980 | Root . | |
| 1,788,556 | 6/1931 | Wood et al. . | |
| 1,994,365 | 3/1935 | Mathews . | |
| 3,273,632 | 9/1966 | McCabe . | |
| 3,327,764 | 6/1967 | McCabe . | |
| 3,525,378 | 8/1970 | Root . | |
| 3,543,440 | 12/1970 | Kurz . | |
| 3,640,307 | 2/1972 | Drzala . | |
| 3,695,105 | 10/1972 | Carlson . | |
| 3,718,081 | 2/1973 | Root . | |
| 3,996,952 | 12/1976 | Root . | |
| 4,432,272 | 2/1984 | Van Becelaere . | |
| 4,444,060 | 4/1984 | Yamamoto | 73/861.66 |
| 4,559,867 | 12/1985 | Van Becelaere et al. . | |
| 5,379,792 | 1/1995 | Van Becelaere | 137/12 |
| 5,449,319 | 9/1995 | Dushane et al. | 454/319 |

*Primary Examiner*—Harold Joyce
*Assistant Examiner*—Derek S. Boles
*Attorney, Agent, or Firm*—Litman, McMahon & Brown L.L.C.

[57] ABSTRACT

An adjustable damper for controlling air flow from one area to another includes a rectangular frame forming an opening with a number of movable vanes positioned to selectively close off or open up the opening. Positioned between each pair of vanes in the frame is a stationary pitot-static sensing vane. Each pitot-static sensing vane can also be shaped as an air foil and includes an upstream chamber connected to a ram air input aperture and a downstream chamber connected to a downstream static aperture. Each of the chambers is connected to one portion of a pressure sensing instrument, such as, for example, a diaphragm type differential pressure sensor, in order to sense air flow velocity across the damper.

12 Claims, 2 Drawing Sheets

Fig. 4.
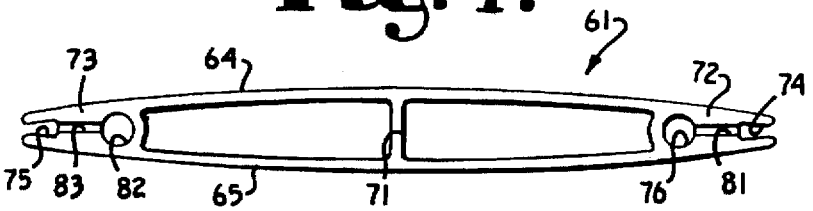
Fig. 5.
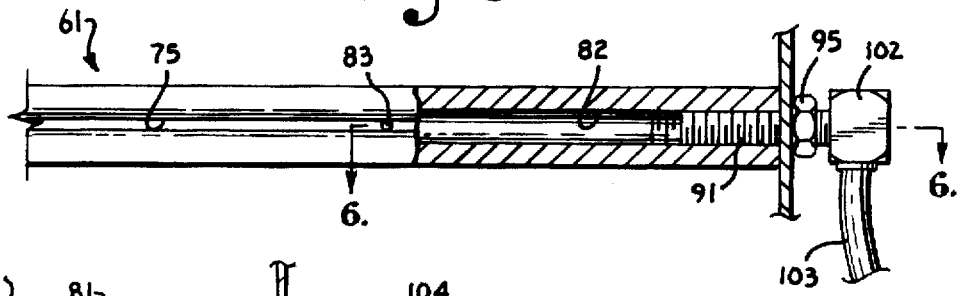
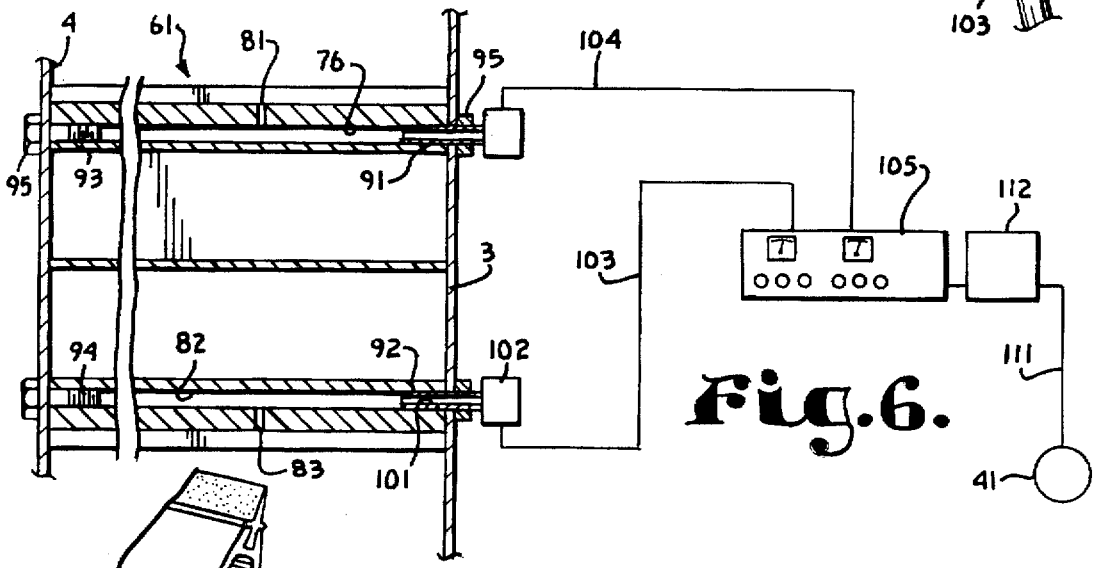
Fig. 6.
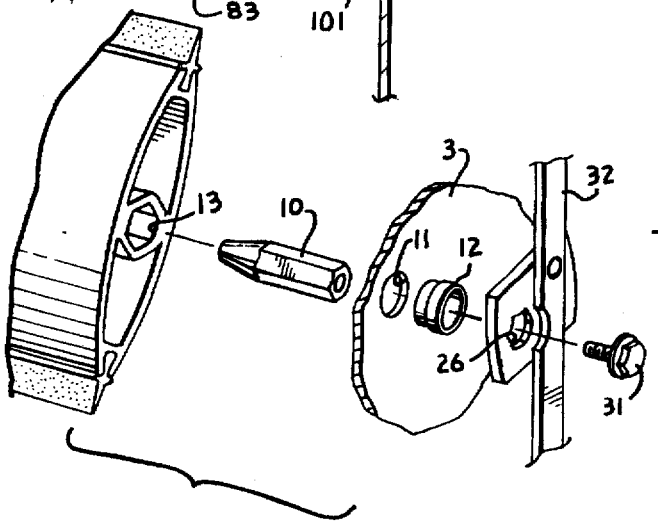
Fig. 7.

DAMPER WITH STATIONARY PITOT-STATIC SENSING VANES

FIELD OF THE INVENTION

The present invention relates to an adjustable damper such as those used to selectively control air flow into and out of a portion of a building, such as, for example, ambient outside air into a Heating, Ventilation and Air Conditioning (HVAC) system. More particularly, the inventive damper includes a frame defining an opening with a plurality of selectively rotatable blades or vanes positioned therein. The vanes can be rotated by a motor and connected linkage between a vertical, or closed position, at which they collectively block air flow through the opening, and an open position, at which they allow maximum air flow through the opening. Between each adjacent pair of rotatable vanes is positioned a special, horizontally oriented stationary vane which forms a part of a pitot static system for sensing differential pressure across the damper.

BACKGROUND OF THE INVENTION

Heating and Air Conditioning (HVAC) systems for modern buildings and factories are generally precisely regulated to control the amount of outside air introduced into the system. In such systems, the designer must balance the need for energy conservation, which entails minimizing the amount of new outside air which must be introduced, and therefore heated or cooled, vs. the competing need for adequate fresh air ventilation to prevent the accumulation of stale air and the accompanying effects of so-called "sick building syndrome" on occupants.

Typically, in such controlled HVAC systems, outside air is introduced via selectively controllable dampers. For example, a damper can be a rectangular frame built into a wall communicating with the exterior of the building. Within the rectangular frame, a plurality of rotatable vanes are positioned, which vanes are selectively rotatable between a vertically oriented, completely closed position at which no air is introduced, and a substantially horizontally oriented, completely open position at which maximum air is introduced. Between these extreme positions are an infinite number of intermediate, partially open positions.

In order to accurately control the amount of ambient air introduced into a building, the air flow across the damper must be known. The conventional method of sensing air flow is to place a pitot tube sensor in the air stream to measure the difference between the upstream and the downstream pressures to determine the differential or velocity pressure. The velocity pressure is directly proportional to the air flow across the damper such that, by sensing the velocity pressure and consulting a flow table, the correct damper setting can be selected. The correct placement of pitot tube sensors in a damper has proven to be problematic in many cases. If a pitot tube is permanently installed in a damper, maintenance can be a major problem. If the pitot tube is installed alongside the damper, it may not be correctly placed to account for wind gusts and shifts, etc. at the damper opening itself.

One example of an effort to avoid these problems is represented by U.S. Pat. No. 5,379,792, (the '792 patent) issued Jan. 10, 1992 to the present inventor, which is hereby incorporated by reference. In the '792 patent, one or more of the movable vanes themselves was set up as a pitot-static velocity pressure sensor. Each sensing vane included upstream apertures facing the ambient air side of the damper and downstream apertures facing the side of the damper facing the interior of the building. The apertures communicated with corresponding chambers in the vane which chambers were connected to a diaphragm type differential pressure sensor or manometer to determine velocity pressure, i.e. dynamic (upstream) pressure less static (downstream) pressure. This sensed differential pressure was used, either directly, or via control instruments, to control the position of the vanes in the damper.

While the '792 patent represented a substantial improvement over prior art damper associated pitot static sensors, it still had shortcomings. Chief among these was the fact that, since the movable vanes themselves were also pitot static sensors, as the position of the vane changed during opening or closing of the damper, the angle of the pitot and static apertures also changed. Thus, the relationship between the sensed upstream, dynamic pressure and the sensed downstream, static pressure, was constantly changing as the vane angle changed. Accordingly, the vane sensors could only be reliably used to detect velocity pressure, and thus to generate damper control signals, when a complicated calibration table was calculated with varying control ratios for each different vane position.

It is clear then, that a need exists for an improved apparatus for sensing the differential or velocity air pressure across a damper equipped with movable vanes. The pressure sensing system should reliably detect velocity pressure regardless of the position of the damper vanes so that air flow can be precisely controlled.

SUMMARY OF THE INVENTION

The present invention is directed to an adjustable damper for controlling air flow from one area to another, such as between outside ambient air and interior ducting of an HVAC system of a building. The damper includes a rectangular frame forming an opening with a number of pairs of selectively rotatable axles extending from either side of the frame into the opening. A plurality of movable vanes are attached to respective pairs of the axles and each vane preferably forms an air foil shape and can be made of extruded aluminum, for example. All of the axles on one side of the frame are selectively, simultaneously rotated by a linkage attached to a drive shaft. The drive shaft is extendable or retractable via a motor to control the position of the connected vanes. Positioned between each pair of vanes in the frame is a stationary pitot-static sensing vane. Each sensing vane can also be shaped as an air foil and includes an upstream chamber connected to an upstream ram air input aperture and a downstream chamber connected to a downstream static aperture. Each of the chambers is connected to one portion of a pressure sensing instrument, such as, for example, a diaphragm type differential pressure sensor or manometer for a readout, or for directly generating a damper control signal. Each movable vane includes a gasket attached along both top and bottoms of the vane to seal the vane against the stationary sensing vanes as well as against the top and bottom edges of the frame opening.

OBJECTS AND ADVANTAGES OF THE INVENTION

The principal objects of the present invention include: providing an improved damper with one or more stationary pitot-static sensing vanes; providing such a damper with selectively rotatable vanes which, collectively, alternatively, close off or open up air flow through the damper; providing such a damper in which the stationary pitot-static sensing vanes are positioned between respective pairs of the movable vanes; providing such a damper in which the stationary pitot-static sensing vanes reliably detect differential pressure across the damper in all conditions, thus providing an accurate signal for controlling the damper position to allow a predetermined air flow; to provide such a damper which is rugged in construction and reliable and durable in operation; and providing such a damper which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a greatly enlarged, cross-sectional view of a single one of the pitot-static sensing vanes.

FIG. 5 is a greatly enlarged, fragmentary, front elevational view of a portion of a single one of the pitot-static sensing vanes attached to a sidewall of the damper frame and with portions broken away to illustrate a pressure sensing chamber connected to a pressure line.

FIG. 6 is a greatly enlarged, fragmentary, cross-sectional view, taken along line 6—6 of FIG. 5, and showing a single one of the pitot-static sensing vanes attached to a sidewall of the damper frame and with both an upstream and a downstream pressure sensing chamber connected to respective pressure lines which are, in turn, connected to a manometer.

FIG. 7 is a greatly enlarged, fragmentary, perspective view, showing a single one of the movable vanes attached to an axle extending through a sidewall of the damper frame and with the axle connected to a linkage arm for opening and closing the movable vane.

DETAILED DESCRIPTION OF THE INVENTION

Figure 1:
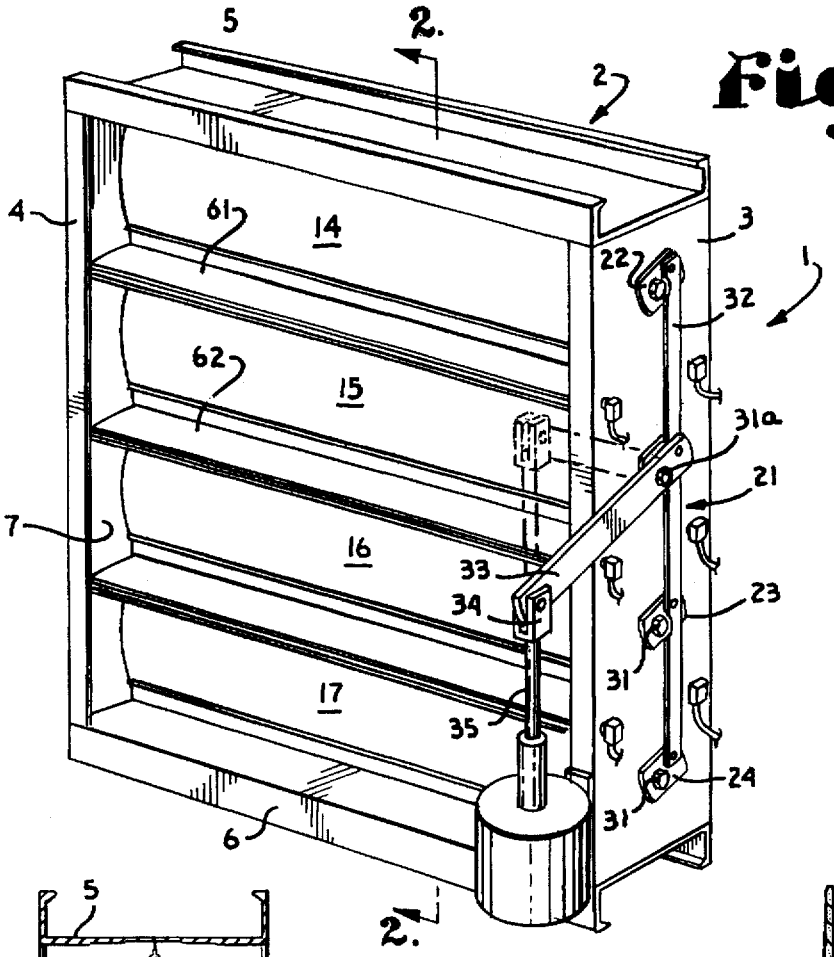
FIG. 1 is a perspective view of a damper equipped with both stationary pitot-static sensing vanes and movable vanes in accordance with the present invention, shown with the movable vanes closed to block air flow therethrough.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–8, the reference numeral 1 generally indicates a damper in accordance with the present invention. The damper 1 includes a generally rectangular frame 2 which is of a width which will fit within the width of a wall, such as a standard 2×4 or 2×6 stud wall, for example. The frame 2 includes side members 3 and 4 and top and bottom members 5 and 6, respectively, which collectively form a rectangular opening 7 in the frame 2.

A plurality of axles 10 extend inward through bores 11 in the side frame members 3 and 4 (FIG. 7). The axles 10, which are shown as hexagonal in cross section, are arrayed in pairs opposite each other. One end of each axle 10 fits within a respective sleeve 12 positioned within the bore 11 and an opposite, tapered end of each axle 10 fits within a respective receiving sleeve 13 on one of a plurality of rotatable vanes 14–17. The receiving sleeves 13 have an interior hexagonal shape which secures the axles 11 such that the vanes are fixed with respect to the axles 11. The axles 11 are thus rotatable relative to the side frame members 3 and 4, and the attached vanes 14–17 rotate along with the axles 11.

Referring to FIGS. 1 and 7, a linkage system for simultaneously rotating the vanes 14–17 is generally indicated at 21. The linkage system 21 includes three plates 22–24, each of which has a hexagonal bore 25 sized to receive a respective axle 10. Each axle 10 is connected to the respective plate 22–24 via a threaded bolt 31 such that, as the respective plate 22–25 pivots, it partially rotates the respective connected axle 10. A first linkage arm 32 is pivotally connected at an upper end to the plate 22, at intermediate points to the plates 23 and 24, and at a lower end to the plate 25. A second linkage arm 33 is attached near one end thereof to the plate 23 via an elongate bolt 31*a*, and is pivotally connected near the same end to the first linkage arm 32. The second linkage arm 33 is pivotably connected at an opposite end to a yoke 34 forming a portion of a drive shaft 35. The drive shaft 35 is selectively extendable and retractable via a reversible motor 41. Thus, as the motor 41 extends the drive shaft 35 between the solid line and the dotted line positions shown in FIG. 1, the plate 23 is partially rotated by the second linkage arm 33, along with the connected axle 10 and the movable vane 15. The movable vane 15 is thus rotated from a vertical, closed position to an open, substantially horizontal position. At the same time, the first linkage arm 32 is pulled downward, also partially rotating the other plates 22, 24 and 25, which causes the movable vanes 14, 16 and 17, respectively, to also be rotated in the same direction, i.e. from the vertical, closed position to an open, substantially horizontal position, as shown in broken lines in FIG. 2.

Figure 3:
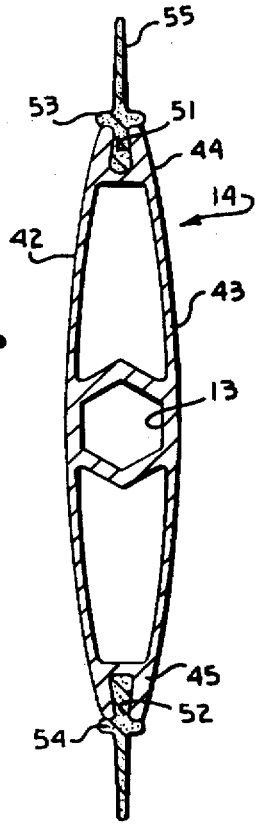
FIG. 3 is a greatly enlarged, cross-sectional view of a single one of the movable vanes.

Referring to FIG. 3, one of the movable vanes, here indicated as 14, is shown in cross-section. The vane 14 is formed as a symmetrical air foil, with opposite curved sidewalls 42 and 43 connected by the central receiving sleeve 13 as well as upper and lower walls 44 and 45. The movable vane 14 can be made by extruding aluminum into the required shape. The walls 44 and 45 are spaced from each end of the vane 14 to from respective slots 51 and 52. A pair of identical gaskets 53 and 54 are inserted into the slots 51 and 52, respectively, allowing a flexible portion 55 to extend outward from either end of the vane 14.

Figure 2:
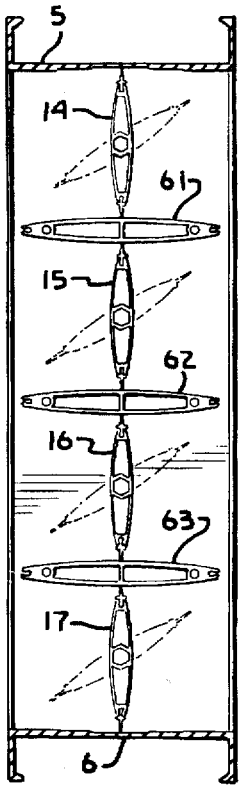
FIG. 2 is a cross sectional view of the damper, taken along line 2—2 of FIG. 1, also illustrating the rotatable vanes in a closed position in solid lines and a partially open position in broken lines and showing the cross-sectional shape of each pitot-static sensing vane and movable vane.

Referring to FIGS. 1, 2 and 4–6, the damper 1 also includes a plurality of pitot static sensing vanes 61–63 with each pitot static sensing vane 61–63 positioned in a substantially horizontal orientation between a respective pair of the movable vanes 14–17. Each of the pitot static sensing vanes 61–63 is also shaped as a symmetrical air foil, although of a narrower profile than the vanes 14–17, as shown in the vane 61 illustrated in cross-section in FIG. 4. The pitot static sensing vane 61 includes opposite curved sidewalls 64 and 65 connected by a central wall 71 as well as an upstream block 72 and a downstream block 73. The sidewalls 64 and 65 extend past the blocks 72 and 73 to form respective slots 74 and 75. The upstream block 72 includes a pitot pressure sensing chamber 76 extending along the width of the vane 61, which chamber 76 is preferably cylindrical in shape. A ram air aperture 81 is formed in the front end of the upstream block 72 with the aperture 81 communicating with the pitot chamber 76. The downstream block 73 includes a static pressure sensing chamber 82 extending along the width of the vane 61, which chamber 82 is also preferably cylindrical in shape and identical in size to the chamber 76. A static air aperture 83 is formed in the rear end of the downstream block 73 with the aperture 83 communicating with the chamber 82. The pitot static sensing vane 14 can also be made by extruding aluminum into the required shape. As shown in FIGS. 1 and 2, as each of the movable vanes 14–17 is rotated to the closed position, the gaskets 53 and 54 of each movable vane 14–17 seat against the respective adjacent pitot static sensing vane 61–63 l off air flow between it and the adjacent pitot static sensing vane 61–63 or upper and lower frame member 5 and 6.

Referring to FIGS. 2, 5 and 6, each pitot static sensing vane 61–63 is attached between the side frame members 3 and 4. A threaded pair of threaded rods 91 and 92 extend into the chambers 76 and 82, respectively from the side frame member 3. A second pair of threaded rods 93 and 94 extend into the chambers 76 and 82, respectively from the side frame member 4. Each end of each chamber 76 and 82 has female threads adapted to receive the respective rod 91–94. A respective one of a plurality of securing nuts 95 are tightened onto each exposed end of the threaded rods 91–94 to secure it into place, thus holding the respective pitot static sensing vane in place within the frame 2.

Each threaded rod 91 and 92 has a hollow core 101 which communicates with a respective pressure line adaptor 102 such that the static chamber 82 in each pitot static sensing vane 61–63 is connected to a respective static pressure line 103 and each pitot chamber 76 is connected to a respective pitot pressure line 104. The pressure lines 103 and 104 are connected to a differential pressure measuring instrument or manometer 105 such that an output signal can be produced on a control line 111 from a calibration circuit 112 for controlling the motor 41, as represented schematically in FIG. 6. While single lines 103 and 104 are shown in FIG. 6, it should be noted that pitot and static pressure lines from all three pitot-static sensing vanes 61–63 can be combined prior to introduction into the manometer 105.

As described in the '792 patent, the pressure sensed in the pitot pressure line 104 constitutes both velocity and static pressure while the pressure sensed in the static pressure line 103 constitutes static pressure only. The difference between the two sensed pressures is the differential or velocity pressure, which can be used by an operator to adjust the blade positions of the movable vanes 14–17 to effect the desired fluid flow through the damper 1. As in the '792 patent, empirical testing of the pitot-static sensing vanes reveals that, at most positions of the movable vanes 14–17, the measured velocity, as determined by the pitot-static sensing vanes 61–63 is multiplied by a factor of 3 or more over the actual velocity. This is presumably still due to downstream turbulence about the pitot-static sensing vanes 61–63, but the amplification of measured velocity can be useful. The amplification also varies as a function of the position of the movable vanes 14–17, with one example of a chart of measured vs. actual fluid velocity for a damper 45.25" long by 18.5" wide indicated by table 1 below:

TABLE 1

| DAMPER POSITION | CALC VEL | MEAS. VEL | RATIO | CORRECT FACTOR |
|---|---|---|---|---|
| 100% OPEN | 0.016 | 0.05 | 3.21 | |
| | 0.035 | 0.11 | 3.14 | |
| | 0.062 | 0.20 | 3.21 | |
| | 0.097 | 0.30 | 3.08 | |
| | 0.140 | 0.43 | 3.07 | 3.140 |
| 87.5% OPEN | 0.016 | 0.050 | 3.21 | |
| | 0.035 | 0.115 | 3.28 | |
| | 0.062 | 0.205 | 3.29 | |
| | 0.097 | 0.320 | 3.28 | |
| | 0.140 | 0.480 | 3.42 | 3.296 |
| 75% OPEN | 0.016 | 0.10 | 6.42 | |
| | 0.035 | 0.23 | 6.56 | |
| | 0.062 | 0.41 | 6.58 | |
| | 0.097 | 0.71 | 7.29 | |
| | 0.140 | 1.10 | 7.84 | 6.936 |
| 62.5% OPEN | 0.016 | 0.18 | 11.55 | |
| | 0.035 | 0.41 | 11.69 | |
| | 0.062 | 0.81 | 12.99 | |
| | 0.097 | 1.37 | 14.06 | |
| | 0.140 | 2.00 | 14.26 | 12.911 |
| 50% OPEN | 0.016 | 0.45 | 28.87 | |
| | 0.035 | 1.02 | 29.09 | |
| | 0.062 | 1.85 | 29.67 | |
| | 0.097 | 3.00 | 30.80 | |
| | 0.125 | 4.10 | 32.93 | 30.272 |
| 37.5% OPEN | 0.016 | 0.93 | 59.67 | |
| | 0.035 | 2.50 | 71.29 | |
| | 0.062 | 4.70 | 75.39 | 68.782 |
| 25% OPEN | 0.016 | 2.90 | 186.06 | |
| | 0.024 | 5.00 | 208.33 | 197.199 |
| 12.5% OPEN | 0.004 | 3.00 | 833.33 | |
| | 0.006 | 5.00 | 819.67 | 826.503 |

The correction factors from this table can be stored in a look-up table in the calibration circuit 112, to allow adjustment based upon measured velocity compensated for damper position as represented feedback from the position of the motor 41.

The inventive damper 1 has been illustrated and described as being of use for a fresh air inlet for an HVAC system, but it would be equally useful in other applications, such as for controlling any opening where fluid flow needs to be regulated. The specific shape of the movable vanes 14–17, the pitot static sensing vanes 61–63 and the pitot and static chambers 76 and 82 is representative, and other shapes might be successfully used.

It is thus to be understood that while certain forms of the present invention have been illustrated and described herein, it is not to be limited to the specific forms or arrangement of parts described and shown.

What is claimed and desired to be secured by Letters Patent is as follows:

1. A damper comprising:

a. a frame forming an opening for fluid flow between an upstream side and a downstream side of said damper;

b. a movable vane in said opening, said first vane being selectively movable about an axis between a substantially closed position at which it blocks at least a portion of said opening and an open position allowing fluid flow through said opening;

c. a stationary vane in said opening, said stationary vane being fixed in position and including a pitot static system which forms a portion of a differential fluid pressure sensor, at least a portion of said stationary vane being aligned with the axis of said movable vane such that said movable vane abuts said stationary vane when said movable vane is in the closed position.

2. A damper as in claim 1, and wherein said movable vane includes a gasket for seating against said stationary vane to seal off fluid flow through said damper.

3. A damper as in claim 1, wherein said stationary vane comprises:

a. a first chamber;

b. a first orifice connecting said first chamber to said high fluid pressure region;

c. a second chamber;

d. a second orifice connecting said second chamber to said low fluid pressure region.

4. A damper as in claim 3, and further comprising:

a. a differential pressure sensor connected to both said first and said second chambers.

5. A damper as in claim 3, wherein said stationary vane is shaped as a symmetrical airfoil with an upper and lower surface tapering toward each other on both the upstream and the downstream side of said damper with an upstream slot and a downstream slot formed between said two sides.

6. A damper as in claim 5, wherein said first orifice is formed in said upstream slot and said second orifice is formed in said downstream slot, said first and second chambers being formed between said upper and lower sides of said stationary vane and being positioned proximate said upstream and downstream slots, respectively.

7. A damper as in claim 5, wherein there are a plurality of said movable vanes and a plurality of said stationary vanes with the number of said movable vanes being one greater than the number of said stationary vanes.

8. A damper comprising:

a. a frame forming an opening for fluid flow between an upstream side and a downstream side of said damper;

b. a movable vane in said opening, said movable vane being selectively movable about an axis between a substantially closed position at which it blocks at least a portion of said opening and an open position allowing fluid flow through said opening;

c. a stationary vane in said opening, said stationary vane being fixed in position, at least a portion of said stationary vane being aligned with the axis of said movable vane such that said movable vane abuts said stationary vane when said movable vane is in the closed position and including:

i. a first chamber;

ii. a first orifice connecting said first chamber to said high fluid pressure region;

iii. a second chamber;

iv. a second orifice connecting said second chamber to said low fluid pressure region; and d. a differential fluid pressure sensor connected to said first and second chambers.

9. A damper as in claim 8, and wherein said movable vane includes a gasket for seating against said stationary vane to seal off fluid flow through said damper.

10. A damper as in claim 8, wherein there are a plurality of said movable vanes and a plurality of said stationary vanes with the number of said movable vanes being one greater than the number of said stationary vanes and with each said stationary vane being positioned between two adjacent ones of said movable vanes.

11. A damper comprising:

a. a frame forming an opening for fluid flow between an upstream side and a downstream side of said damper;

b. a plurality of movable vanes in said opening, said movable vanes being selectively movable about respective axes between a substantially closed position at which they block at least a portion of said opening and an open position allowing fluid flow through said opening;

c. a plurality of stationary vanes in said opening with the number of stationary vanes being one less than the number of movable vanes and with each stationary vane being positioned between a respective pair of said movable vanes, each said stationary vane being fixed in position, at least a portion of each said stationary vane being aligned with the axes of said movable vanes such that said movable vanes on either side of each said stationary vane abut the stationary vane when said movable vanes are in the closed position and including:

i. a first chamber;

ii. a first orifice connecting said first chamber to said high fluid pressure region;

iii. a second chamber;

iv. a second orifice connecting said second chamber to said low fluid pressure region; and d. a differential fluid pressure sensor connected to said first and second chambers.

12. A damper as in claim 11, and wherein each said movable vane includes a gasket for seating against the respective stationary vane(s) to seal off fluid flow through said damper.

* * * * *